US009265385B2

(12) United States Patent
Poizot

(10) Patent No.: US 9,265,385 B2
(45) **Date of Patent: *Feb. 23, 2016**

(54) ADAPTATION DEVICE FOR PRODUCTION OF FOAM

(71) Applicant: Chantal Chaussard, Garches (FR)

(72) Inventor: Francis Poizot, Garches (FR)

(73) Assignee: Rieke Corporation, Auburn, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,719

(22) Filed: Nov. 18, 2013

(65) Prior Publication Data

US 2014/0069959 A1 Mar. 13, 2014

Related U.S. Application Data

(62) Division of application No. 11/459,807, filed on Jul. 25, 2006, now Pat. No. 8,590,811.

(30) Foreign Application Priority Data

Jul. 26, 2005 (FR) ..... 05 07949

(51) Int. Cl.
*B05B 7/30* (2006.01)
*A47K 5/14* (2006.01)
(Continued)

(52) U.S. Cl.
CPC ..... *A47K 5/14* (2013.01); *B05B 7/0037* (2013.01); *B05B 11/3023* (2013.01); *B05B 11/3087* (2013.01); *B05B 11/3098* (2013.01)

(58) Field of Classification Search
CPC ..... B05B 11/3087; B05B 11/3023; B05B 11/3098; B05B 7/30; A47K 5/14
USPC ..... 222/189.1, 189.06, 190, 211, 402.18, 222/464.2; 239/343, 339, 590.3, 337, 344, 239/348
See application file for complete search history.

(56) References Cited

U.S. PATENT DOCUMENTS 2,358,329 A 9/1944 Houghton
3,709,437 A 1/1973 Wright
(Continued)

FOREIGN PATENT DOCUMENTS

FR 2884737 A1 10/2006
FR 2889263 A1 2/2007
(Continued)

OTHER PUBLICATIONS

Myers, Drew, Surfactant Science and Technology, 3rd Edition, Wiley-Interscience, Hoboken, New Jersey, 2006, p. 250 & 253.
(Continued)

*Primary Examiner* — Jason Boeckmann
(74) *Attorney, Agent, or Firm* — Woodard Emhardt Moriarty McNett & Henry LLP; James Durlacher

(57) ABSTRACT

The present invention relates to an adaptation device arranged to transform a pump not specific to the production of foam into a foam pump. The device comprises a supply conduit extending from the inlet of the pump as far as an elbow below the level of foaming liquid and rising above the level of the liquid to terminate in air added to the structure of a pump for fluids. The supply conduit comprises a suction hole enabling suction of liquid when air circulates before the hole. A filtering grate is added to a discharge conduit and connected to the pumping outlet. The foaming liquid comprises, in part, water to produce foam without additional water.

5 Claims, 5 Drawing Sheets

(51) Int. Cl.
*B05B 7/00* (2006.01)
*B05B 11/00* (2006.01)

(56) References Cited

U.S. PATENT DOCUMENTS

| | | | | | |
|---|---|---|---|---|---|
| 3,973,701 | A | | 8/1976 | Gardner | |
| 3,985,271 | A | | 10/1976 | Gardner | |
| 4,219,159 | A | * | 8/1980 | Wesner | 239/343 |
| 4,531,659 | A | | 7/1985 | Wright | |
| 4,925,106 | A | * | 5/1990 | Maas et al. | 239/333 |
| 5,071,379 | A | | 12/1991 | Poizot | |
| 5,125,546 | A | | 6/1992 | Dunne et al. | |
| 5,219,102 | A | | 6/1993 | Wright | |
| 5,222,633 | A | | 6/1993 | Blake | |
| 5,624,060 | A | * | 4/1997 | Ellion et al. | 222/376 |
| 5,897,032 | A | * | 4/1999 | Ellion et al. | 222/376 |
| 6,536,685 | B2 | * | 3/2003 | Bennett | 239/343 |
| 6,612,468 | B2 | | 9/2003 | Pritchett et al. | |
| 6,644,516 | B1 | | 11/2003 | Foster et al. | |
| 8,590,811 | B2 | | 11/2013 | Poizot | |
| 2009/0039111 | A1 | | 2/2009 | Tu | |
| 2009/0098067 | A1 | | 4/2009 | Seidling et al. | |

FOREIGN PATENT DOCUMENTS

| | | | |
|---|---|---|---|
| WO | WO 89/09095 | A1 | 10/1989 |
| WO | WO 93/13829 | | 7/1993 |
| WO | WO 2004/078359 | | 9/2004 |
| WO | WO 2004/078359 | A1 | 9/2004 |

OTHER PUBLICATIONS

PCT/EP2012/057294 Written Opinion Nov. 12, 2013.

* cited by examiner

ADAPTATION DEVICE FOR PRODUCTION OF FOAM

RELATED APPLICATIONS

The present application is based on, and claims priority from, French Application Number 05 07949, filed Jul. 26, 2005, the disclosure of which is hereby incorporated by reference in its entirety.

FIELD OF THE INVENTION

The invention relates to the field of production devices for foam by pumps operating on the basis of foaming liquid. It relates more particularly to a device adapting to pumps not specific to the production of foam and enabling them to produce foam from foaming liquid.

BACKGROUND OF THE INVENTION

The foam is utilised for numerous applications, for example as hairdressing foam, as detergent or as body lotion. Foam has several advantages over a gel of the same nature. One example is that foam has a penetration capability greater than gel and rinses more easily. Also, foam is a ready-to-use product as compared to gel which requires to be mixed with water, for example, in a container or on the skin. Another advantage is that there is no loss during application of foam which is compact, as compared to gel, which is less obvious to apply, for example, on the skin. Using foam is therefore more economical.

There are portable apparatuses available which are actuated by hand producing foam. Devices working with a tank of pressurised air and a tank of foaming liquid are known examples of devices. These apparatuses do however have the drawback of not being rechargeable. There are other rechargeable apparatuses available for producing foam. The patent WO2004078359 filed by the company AIRSPRAY describes especially rechargeable apparatus having a special pump for the production of foam. This type of apparatus nevertheless comprises a complex pump which requires numerous elements and complex assembly, in comparison to current pumps for liquid product. Its complexity implies therefore that the apparatus is more expensive than a classic rechargeable pump.

SUMMARY OF THE INVENTION

The aim of the present invention is to propose a device adapting to pumps for liquid product, enabling them to produce foam.

This objective is attained by an adaptation device for the production of foam, the pump comprising at least:

- a tank containing foaming liquid and air,
- pumping means on the one hand suctioning fluid via a pumping inlet and on the other hand expelling this fluid via a pumping outlet,
- a discharge conduit connected to the pumping outlet, characterised in that it comprises:
- a supply conduit open at its two ends, whereof the first end is connected to the inlet of the pumping chamber, whereof the second end terminates in the air contained in the tank or outside the tank, part of the supply conduit circulating below the level of foaming liquid and the supply conduit connected at both its ends by keeping absolute separation between the interior and the exterior of the conduit, with the exception of at least one other opening which is a suction hole made in the supply conduit below the level of the liquid, the size of the suction hole being such that the liquid does not circulate via the hole, except during circulation of air in the supply conduit, at a speed greater than a determined speed.
- a filtering net screen obstructing the discharge conduit.

According to another particular characteristic, an adaptation element of the diameter is connected between the pumping inlet and the first end of the supply conduit.

According to another particular characteristic, the supply conduit is made by a tube with a bend in it comprising a straight plunging part then an elbow then a straight emerging part, the elbow being below the level of the foaming liquid and the suction hole being made in the elbow.

According to another particular characteristic, the supply conduit is made in three fitted tubular parts, being an elbow, a plunger tube and an emerging tube, the U-shaped elbow comprising two connection ends and a suction hole, the plunger tube being connected to the pumping inlet and to a first end of the elbow, the emerging tube being connected to the second end of the elbow and emerging in air.

According to another particular characteristic, a rigid element connects the tank to a part of the emerging tube located in the air inside the tank.

According to another particular characteristic, a rigid element connects a part of the plunger tube to a part of the emerging tube located in the air inside the tank.

According to another particular characteristic, the emerging tube terminates in the air outside the tank by means of a valve passing through the wall of the tank.

According to another particular characteristic, the ratio between the diameter of the hole and the average diameter of the supply conduit has a determined value.

According to another particular characteristic, at least one additional refining net screen is placed in the discharge conduit, so as to obstruct the discharge conduit.

According to another particular characteristic, an extension net screen is placed at the outlet of the discharge conduit, so as to obstruct the discharge conduit.

According to another particular characteristic, the part of the extension net screen obstructing the conduit is composed of three horizontal blades.

According to another particular characteristic, the part of the extension net screen obstructing the conduit is composed of two blades forming a cross.

BRIEF DESCRIPTION OF THE DRAWINGS

Other particular characteristics and advantages of the present invention will emerge more clearly from the description hereinbelow, made in reference to the attached diagrams, in which.

DETAILED DESCRIPTION OF THE DRAWINGS

The invention will be described in reference to FIGS. 1 to 5. The structure will now be described; the production process of foam functioning according to this structure will be described hereinafter. An example of a pumping device not specific to the production of foam is given in FIGS. 2 and 3. The pump comprises an inlet (301) and a pumping outlet (302). In a non-limiting way, the pumping device, according to a particular embodiment comprises a pumping chamber (3). The pumping chamber (3) is cylindrical in shape and narrows at its lower end by a cone. The pumping inlet (301) is located at the end of the cone. The inlet (301) comprises a ball valve (3001) which controls the opening towards the lower part of the pumping chamber (3). The chamber (3) is closed at its upper end by a double piston (3004, 3003, 3005, 3006, 3009). The double piston (3004, 3003, 3005, 3006, 3009) is called this as it comprises a central part (3003) with a sliding pivot, on a determined length with a peripheral part (3004). The outer edges of the peripheral part (3004) of the double piston (3004, 3003, 3005, 3006, 3009) have a V-shaped profile and are placed against the wall of the chamber (3), thus guiding the double piston (3004, 3003, 3005, 3006, 3009) and forming a tight join. The central part (3003) comprises an upper flange (3005) and a lower flange (3006), being translation stops of the peripheral part (3004). The join between the central part (3003) and the peripheral part (3004) is tight. The tightness is reinforced when the peripheral part (3004) is located stopped on a flange (3005, 3006), the peripheral part thus being compressed and deformed. The central part (3003) is tubular and hollow and comprises one or more orifices (302) which form the pumping outlet. The interior of the central part (3003) communicates with the interior of the pumping chamber (3) via this orifice or these orifices (302), when the peripheral part (3004) is not stopped on the low flange (3006). A return spring (3007) is placed in the pumping chamber (3) and is supported on stops (3008) of the pumping chamber (3), at the level of its lower part. The upper part of the spring is supported on a centre point (3009) formed on the central part (3003) of the double piston (3004, 3003, 3005, 3006, 3009).

Figure 1:
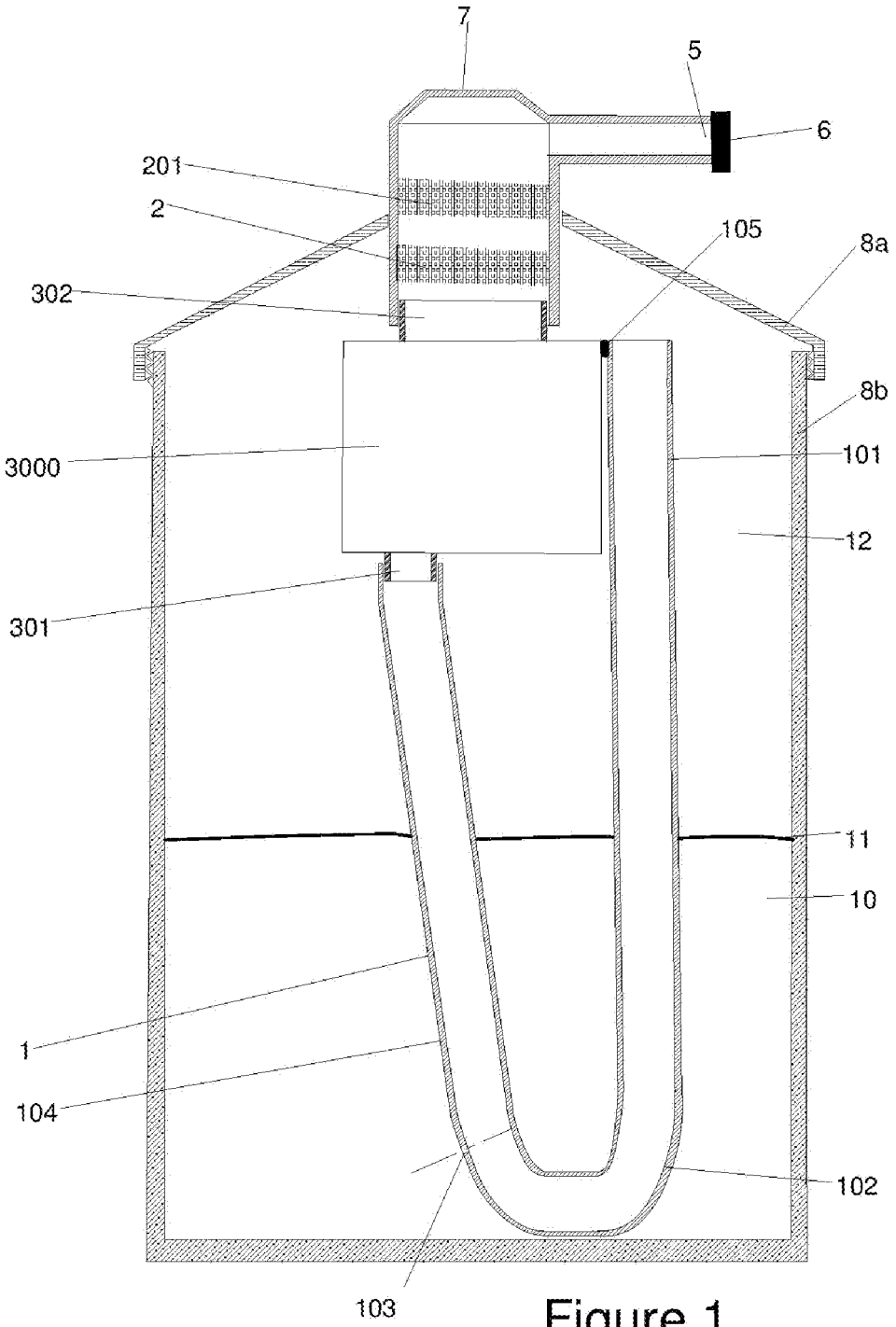
FIG. 1 illustrates all of adaptation device.

A non-limiting example of the structure of the adaptation device is illustrated in FIG. 1. The pumping means (3000), whereof one example was described previously, is symbolised by a frame (3000). Only the pumping outlet (302) and the pumping inlet (301) are illustrated. Other sorts of pumps, preferably manual pumps, are similarly usable. A supply conduit (1) is connected to the pump, on the pumping inlet (301). This conduit (1) comprises a plunging part (104), a bent part (102) and an emerging part (101). The plunging part (104) descends below the level (11) of the foaming liquid (10). It is prolonged by an elbow (102) containing a suction hole (103). The suction hole (103) forms the inlet of the foaming liquid. The suction hole is made at a position corresponding to the bottom of the tank (8*a*, 8*b*) so that the foaming liquid (10) can, for as long as possible, be suctioned via this hole (103). Further, the hole (103) is made to the side of the elbow (102) so as not to be in contact with any possible impurities or agglomerations located in the bottom of the tank (8*a*, 8*b*). The elbow (102) is prolonged by an emerging part (101) which rises above of the level (11) of foaming liquid (10) and emerges in air (12), in a non-limitating way, inside the tank (8*a*, 8*b*). A rigid holding piece (105) is fixed to the pumping device (3000) and to the high part of an emerging part (101) of the supply conduit (1). The aim of this holding device (105) is to keep the end of the supply conduit (1) in the air, in the event where this conduit (1) is made of a flexible material.

Figure 6:
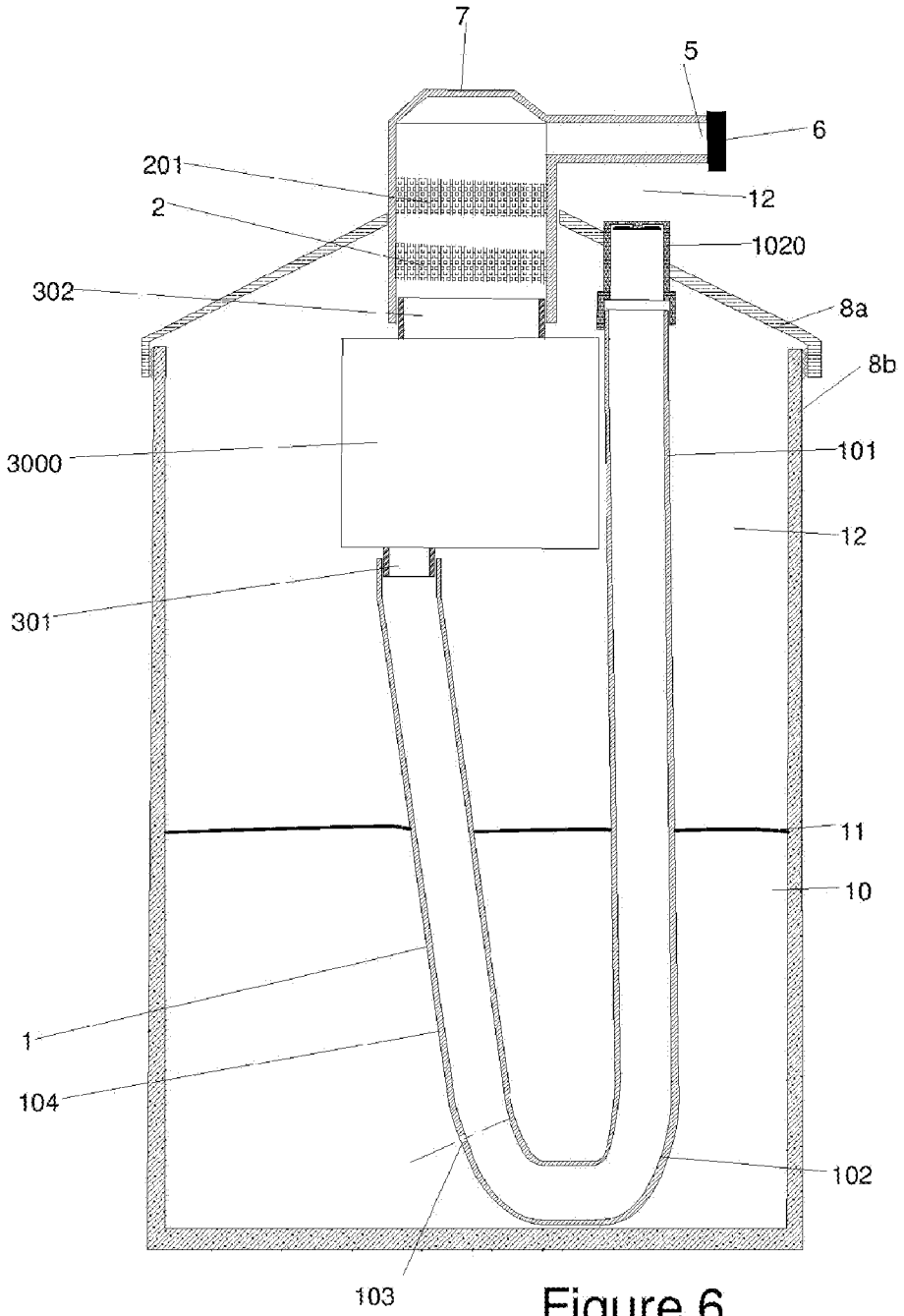
FIG. 6 illustrates another embodiment of the adaptation device.

In another embodiment, the emerging tube emerges in the air outside of the tank (8*a*, 8*b*), by means of a valve (1020) passing through the wall of the upper part of the tank (8*a*). An example of this type of embodiment is given in FIG. 6. In this embodiment, the tube (102) is held by a fitted part in or on the valve (1020). The valve (1020) creates an air inlet in the pipe (102), while preventing circulation of the fluid exiting from the pipe (102). The embodiment is more complicated since it necessitates making a hole in the upper part of the tank (8*a*). The valve is placed in the hole tightly, representing an additional constraint. On the other hand the addition of an additional piece (the valve), increases the cost of the device. This embodiment is given by way of non-limiting example and operates similarly to that of the pipe emerging in air (12) inside the tank (8*a*, 8*b*). However, according to the patent, reference will be made to an emerging tube in the air inside the tank (8*a*, 8*b*) so as to simplify the description.

Figure 5:
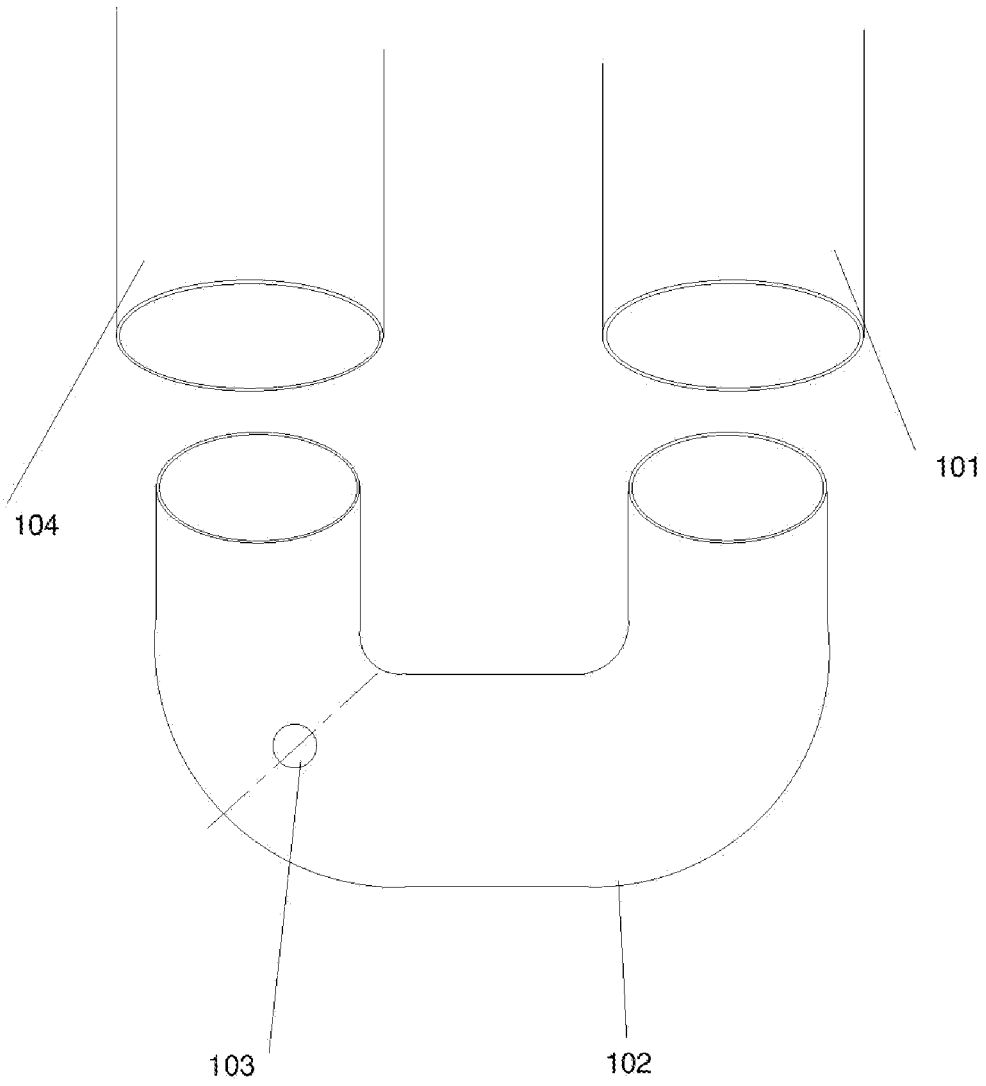
FIG. 5 illustrates a tubular U-shaped elbow (102) in the case of a supply conduit (1) in three parts (101, 102, 104)

In another embodiment, as illustrated in FIG. 5, the supply conduit (1) is composed of three parts: a U-shaped elbow (103), a first plunger tube (104) and a second (101) emerging tube. The elbow is connected to the two tubes (101, 104) and comprises a suction hole (103) made in a non-limiting way, inclined, for example, at an angle of 45 degrees. The plunger tube (104) is connected on the other hand to the pumping inlet (301). The emerging tube (101) terminates in air (12). According to another embodiment, the suction hole is not present and is replaced by a low-quantity diffusion device. In a non-limiting way this diffusion device comprises a valve located above a hole of determined size and shape. For this embodiment comprising a diffusion device, the conduit is made in three parts, the diffusion device being located in the tubular elbow (103).

In an example of use, a pump not specific to the production of foam can easily be modified according to the invention to become a foam pump. The liquid (10) is suctioned into the pumping chamber (3) via the pumping inlet (301) which is connected to a plunger tube whereof the end arrives below the level (11) of the foaming liquid (10). So as to place the device according to the invention, this plunger tube is pulled out of the pumping inlet (301) and replaced, for example, by a bent supply conduit (1) according to the invention. Pulling out and pressing on the supply conduit (1) according to the invention is done manually, without difficulty, in portable pumps. The plunger tube, present in the original pump, is no longer present as it has been replaced by the supply conduit (1) according to the invention. In an industrial process, the supply conduit (1), according to the invention is put in place by means directly on the pumping inlet (301).

Figure 4:
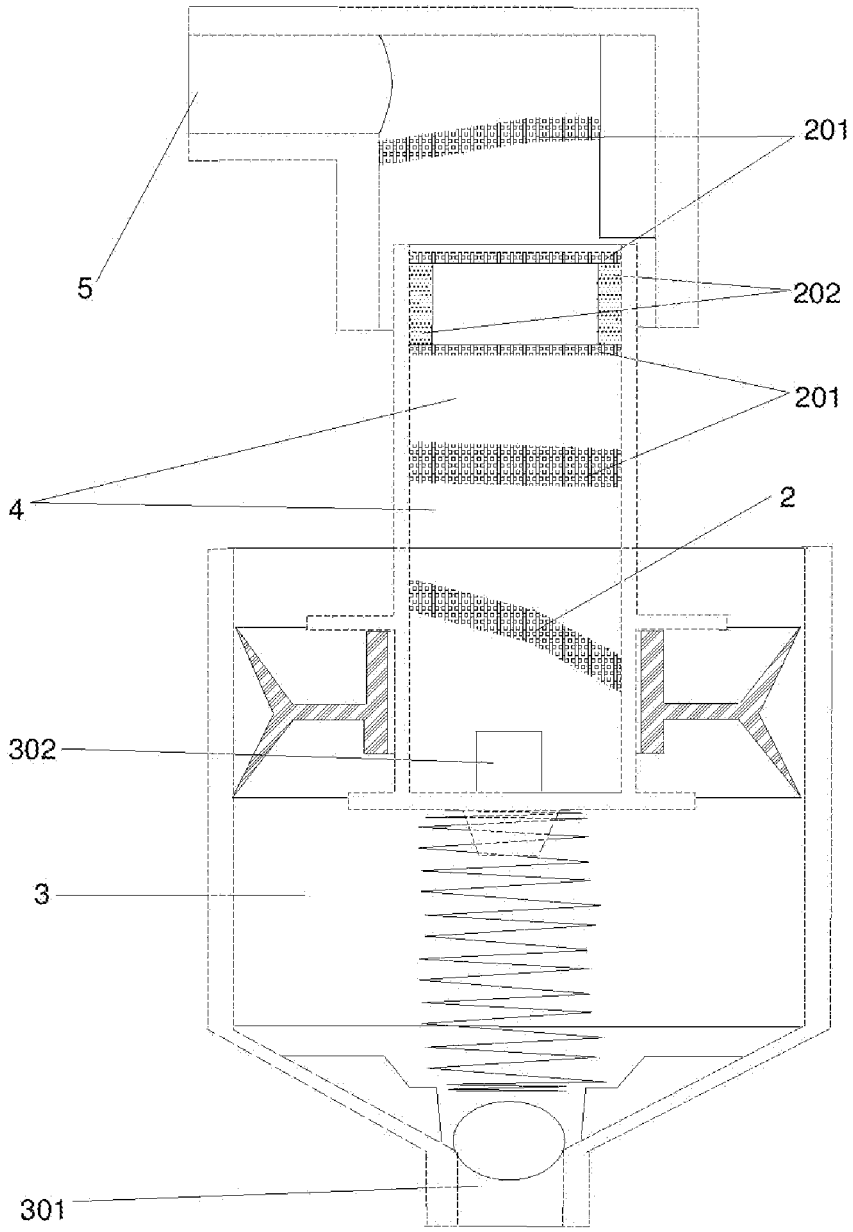
FIG. 4 illustrates a discharge conduit in which filtering net screens have been inserted.

The structure of the adaptation device likewise comprises, in a non-limiting way, one or more net screens (2, 201, 6), as illustrated in FIGS. 1 and 4. In the structure of pumps not specific to the production of foam, the pumping outlet (302) terminates in a discharge conduit (4) which terminates in a projection head (5). The filtering net screen (2) is placed in the discharge conduit (4). The size of the mesh of the net screen (2) will be detailed herein below. In an embodiment a round net screen, of the same diameter as a circular discharge conduit (4), is positioned across the discharge conduit (4), perpendicular to the direction of flux. The discharge conduit (4) is thus blocked, that is, the filtering net screen (2) occupies the whole conduit without sealing it hermetically. In another embodiment an oval net screen is placed obliquely in a circular discharge conduit (4). The dimensions of this oval net screen correspond to those of the circular conduit, such that the net screen is supported on the whole interior periphery of the discharge conduit (4). Similarly as in the preceding example, the oval net screen obstructs the discharge conduit (4). In another embodiment a discharge conduit (4) having an undetermined and rounded shape is connected to a flexible net screen which assumes the form of the discharge conduit (4), obstructing the conduit (4). In a non-limiting way one or more additional filtering net screens (201) are added in the discharge conduit (4), across the discharge conduit (4). These additional net screens (201) are placed after the first filtering net screen (2), according to the direction of circulation of the fluid in the discharge conduit (4). In an embodiment, several additional filtering net screens (201) are added to the discharge conduit (4). A space remains between each net screen. In an embodiment a strut (202) is placed between two net screens (201, 2). In another embodiment, two net screens are placed one above the other, jointly, and are equivalent to a finer net screen. In an embodiment, an extension net screen (6) is added on to the projection head (5). The aim of this latter net screen (6), in a non-limiting way, is to regulate the rate, enlarge the jet or modify the structure of the jet. The different net screens (2, 201, 6) are held in the pump, in a non-limiting way by gripping or by adhesion. According to a variant embodiment, the filtering net screen (2) has one or more degrees of liberty relative to the discharge conduit (4) of the pump and obstructs the discharge conduit (4), irrespective of its position.

The pumping device expels the fluid via a pumping outlet (302) connected to a discharge conduit. In an embodiment, the discharge conduit is removed and a filtering net screen (2) is pressed on to the conduit so as to obstruct it. Another embodiment is to fix the net screen in the conduit by adhesion. In another embodiment, the projection head (5) is situated at a determined distance, for example, around 4 cm from the pumping outlet (302) and the conduit is composed of three pieces, as illustrated in FIG. 4. It is therefore possible to insert several filtering net screens with a space between each net screen. In a non-limiting way, the net screens are held gripped in the conduit or fixed by adhesion. In another embodiment, two net screens are kept away from one another by a strut (202). In an industrial process, the filtering net screens (2, 201) are inserted into the discharge conduit (4) before or during assembly of the pump.

Figures 2, 3:
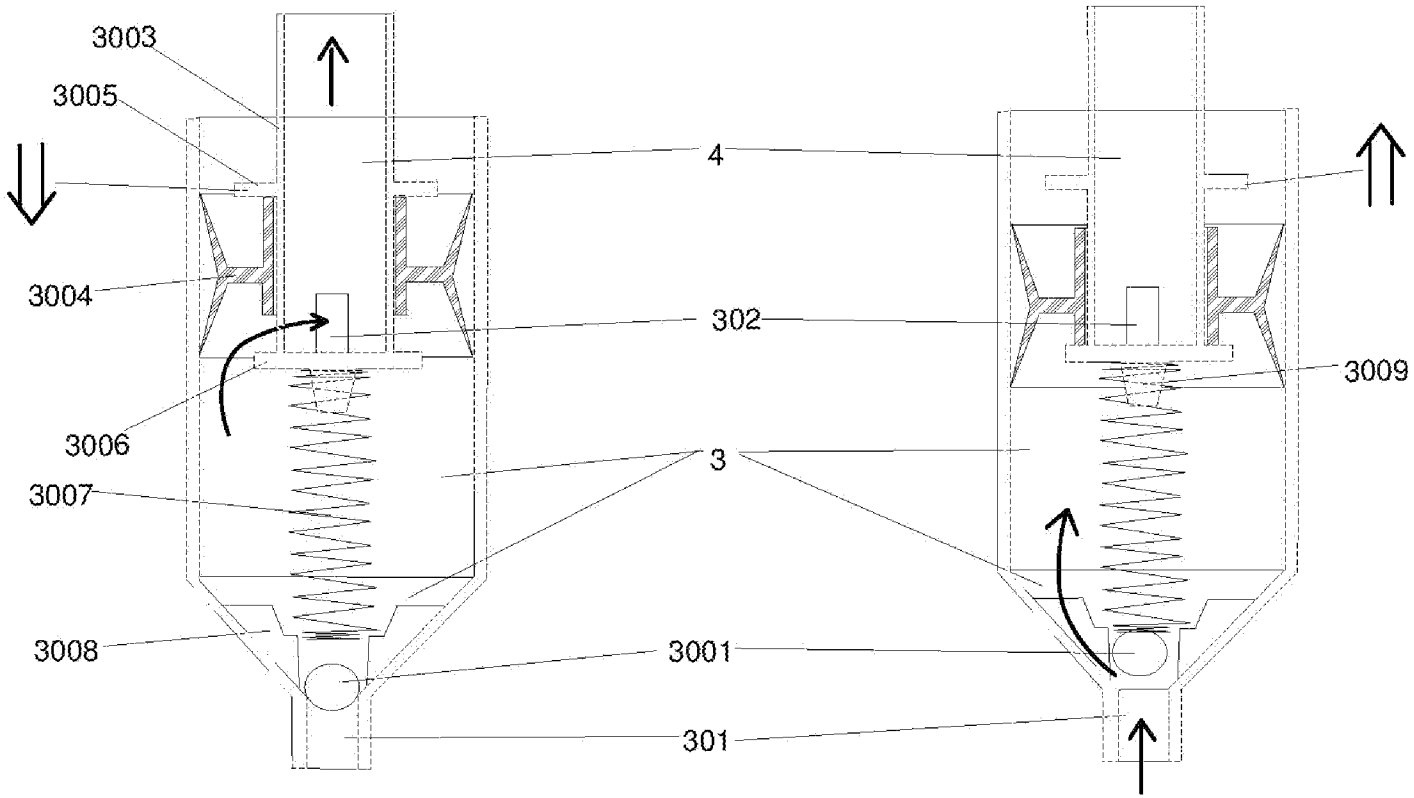
FIG. 2 illustrates the configuration of a pump in the expulsion phase.
FIG. 3 illustrates the configuration of a pump in suction phase.

The pumping process will now be described. The pumps comprise a pump pushing liquid by a plunger tube and expelling the liquid via a discharge conduit (4) terminating in a projection head (5). The user actuates the pump manually by pressure on the head (7) of the pump or by another known mean. The liquid, such as diluted soap, is pumped in two times. The first phase, illustrated in FIG. 2, is an expulsion phase of the contents of a pumping chamber (3). The first phase takes place during pressing on the head (7) of the pump. The second phase, illustrated in FIG. 3, is the filling of the pumping chamber (3). This phase takes place during the return of the piston to the initial position. A spring or another back-pulling mean compressed during the first phase exerts a force in the second phase, allowing the double piston (3004, 3003, 3005, 3006, 3009) to rise. In FIGS. 2 and 3 a double arrow symbolises the movement of the double piston (3004, 3003, 3005, 3006, 3009) relative to the chamber (3) and a single arrow symbolises displacement of the fluid.

The chamber (3) has two openings for circulation of fluid: a pumping inlet (301) and a pumping outlet (302). The openings (301, 302) are connected to an opening and closing system letting the fluid pass in one direction only. In an embodiment, valves control the opening of the inlet (301) and of the pumping outlet (302). In the pumping example, illustrated in FIGS. 2 and 3, a system (3001) utilising a ball prevents the fluid from leaving the pumping chamber (3) in the first phase, but lets the liquid enter in the second phase. The ball is kept between lateral stops (3008), an upper stop and the opening of the chamber (3). The upper stop is made in this example by a support surface of the spring. In FIG. 2, when the liquid contained in the chamber (3) exerts pressure on the ball, the latter is placed against the conical housing and blocks the pumping inlet (301). Inversely, in FIG. 3, the ball rises and lets fluid pass when suction takes place in the chamber (3).

The double piston (3004, 3003, 3005, 3006, 3009) plays a similar role for the pumping outlet (302). It opens the pumping outlet (302) during the expulsion phase, illustrated in FIG. 2, and it blocks the pumping outlet (302) during the suction phase, illustrated in FIG. 3. The opening or closing of the pumping outlet are linked to movements of the piston. When pressure is applied on the double piston (3004, 3003, 3005, 3006, 3009), the mobile part (3004) of the double piston is pushed up, on the one hand because of the friction forces of the chamber (3) on the mobile part (3004) and on the other hand because of the pressure exerted by the fluid. The mobile part therefore moves up, relative to the piston (3004, 3003, 3005, 3006, 3009) and opens the central passage (302). The mobile part (3004), is thus located against the high flange (3005) of the double piston (3004, 3003, 3005, 3006, 3009) and therefore exerts pressure on the liquid contained in the chamber. The liquid is thus expelled through the central passage (302). In the suction phase, illustrated in FIG. 3, the double piston rises under the action of the spring (3007), but its mobile part (3004) is retained by friction forces exerted by the chamber (3) on the mobile part. This mobile part (3004) then descends, relative to the double piston (3004, 3003, 3005, 3006, 3009) and is supported on the low flange (3006), thus blocking the central opening (302). The rise of the double piston (3004, 3003, 3005, 3006, 3009) creates suction in the chamber (3).

The production process of foam according to the invention will now be described. A pumping device, as illustrated in FIGS. 2 and 3, or another pumping device is connected to a structure according to the invention, illustrated in FIG. 1. The foaming liquid is first suctioned via the suction hole (103) at the same time as the air (12) coming from the part of the pipe situated above the level (11) of the liquid (10). A suds forming begins as soon as the foaming liquid (10) is suctioned by this hole (103). The supply conduit (1) therefore contains only air before the elbow in which the suction hole (103) is arranged. In the elbow and after the elbow, the supply conduit (1) contains a mixture of air and foaming liquid. This mixture is then agitated in the pumping chamber (3). Coarse suds are located in the chamber. The fluid is then filtered and emulsified more strongly by a filtering net screen (2) at the outlet of the pumping chamber (3), to produce foam after the net screen (2). The foam is then expelled via the projection head and the extension net screen.

In an embodiment, the production process of foam is likewise based on one or more net screens (201, 6). These are on the one hand additional filtering net screens (201) squeezing the foam and on the other hand regulation or extension net screen (6). These optional net screens are added if the structure of the pump allows it. The net screens (201) added for squeezing the foam allows denser foam. These additional filtering net screens (201) are placed, according to a non-limiting example, one after the other, in the discharge conduit (4) with a space between each of the net screens. Each of these net screens compresses the foam, which becomes increasingly denser. In an embodiment, the meshing of the additional net screens (201) is increasingly finer. A removable extension or regulation flow net screen (6) adapts, in a non-limiting way, to the projection head (5). It modifies the structure of the foam or respectively regulates the flow of foam. In the example of an extension net screen (6), non-limiting examples are: a plastic ring comprising parallel equidistant blades or a ring comprising two crossed blades, for separating the foam jet. This results in a multiple jet, for example.

The dimensions will now be described. The adaptation device according to the invention is composed of several elements which adapt to pumps not specific to the production of foam. The elements added to a pump have dimensions in a functional range. The variation in dimensions produces different structures of foam or different rates. The dimensions likewise depend on foaming liquid, according to whether it is more or less foaming or more or less diluted.

In a non-limiting way the diameter of the suction hole of the foaming liquid in the supply conduit (1) depends on the viscosity of the foaming liquid (1). The more viscous the liquid is, the larger the size of the diameter of the hole. For the same liquid, different diameters of the hole are possible. This gives a minimum size and a maximum size. The maximum size is the limited size for which, when the pump is at rest, there is no rising of the foaming liquid in the supply conduit (1). Beyond this maximum size, when the pump is at rest, the liquid rises in the supply conduit (1), arriving in a non-limiting way at the level (11) of the foaming liquid (10) in the tank (8*a*, 8*b*). The minimum size is the size below which the foaming liquid is not suctioned during pumping. The size of the diameter of the suction hole (103) in part determines the nature of the foam. The larger the diameter, the greater the proportion of foaming product in the foam. The diameter of the supply conduit (1) likewise has an influence in the production of the foam. The narrower the average diameter, the more the suctioned air will be halted. The airflow suctioned by pumping of the pump will therefore be slower. The speed of air (12) at the level of the suction hole (103) influences the quantity of suctioned liquid. In a non-limiting way and by remaining in operating ranges, the greater the average diameter of the supply conduit (1), the greater the proportion of air (12) contained in the foam and the lighter the foam will be. Inversely, the supply conduit (1) has a maximum diameter. Beyond this maximum diameter, air no longer passes fast enough over the hole (103) to create a suction phenomenon of the foaming liquid (10) via the suction hole (103). Thus, it is appropriate to judiciously adapt the ratio between the size of the hole (103) and the diameter of the pipe. By way of non-limiting examples, the inner diameter of the supply conduit can vary from 3 mm to 15 mm and the diameter of the suction hole can vary from 1 mm to 5 mm. These values of diameters are chosen depending on the product used.

The filtering net screen likewise has a role in the nature of the foam. Its dimensions influence the finesse of the foam and therefore its density. The more the filtering net screen (2) has a fine mesh, the denser the foam will be. On the other hand, in a non-limiting way, the size of the mesh of the net screen is a function of the dimensions of the other elements and also of the dilution of the foaming liquid (10). In another embodiment, additional filtering net screens (201) are added to the discharge conduit (4). In a non-limiting way, the mesh sizes of the filtering net screens (2, 201) are selected to decrease from the first filtering net screen (2) to the last additional filtering net screen (201), the latter additional net screen being the closest to the projection head (5). In a non-limiting way, a mobile extension net screen (6) is placed at the level of the projection head (5). This mobile net screen (6) therefore allows the device to operate in two modes, with or without the net screen (6). The extension net screen (6) either enlarges the foam jet, or regulates the foam jet.

In a known manner, the foaming liquid transforms into foam when it is mixed with water and undergoes agitation. The device according to the invention enables the production of foam without additional water. The foaming liquid (10) contained in the tank (8*a*, 8*b*) therefore contains a product having foaming properties diluted with water. In a non-limiting way dilution of the foaming liquid is carried out according to a mixture comprising 20% to 80% water. The more the foaming liquid (1) is concentrated the richer the foam will be, composed of a significant proportion of active agent. An example of active agent is, for example, a covering element in a styling mousse. In this example, the foaming liquid (10) is composed of an active agent, applied to the hair, of a foaming agent and water. In a non-limiting way, dilution is carried out as a function of the dimensions of the other elements of the device according to the invention.

It must be evident for those skilled in the art that the present invention enables embodiments in numerous other specific forms without departing from the scope of application of the invention as claimed. Consequently, the present embodiments must be considered by way of illustration, but may be modified in the field defined by the reach of the attached claims, and the invention must not be limited to the details given hereinabove.

The invention claimed is:

1. A device for producing foam, the device comprising:
a tank for containing foaming liquid;
a supply of foaming liquid in said tank;
a pump configured to suction foaming liquid via a pumping inlet and expelling foaming liquid via a pumping outlet;
a discharge conduit connected to the pumping outlet;
a supply conduit having a first end connected to the pumping inlet and a second end open to air for the intake of air to produce foam, part of the supply conduit positioned such that the pump is operable if a level of the foaming liquid in the tank is above the part of the supply conduit, the supply conduit and both its first and second ends connected and arranged in the tank so the fluid in the tank does not flow into the interior of the supply conduit, except for fluid flowing through (a) the second end and (b) at least one suction hole formed in a wall of the supply conduit between the two ends coming out in the foaming liquid and positioned such that the pump is operable if the level of the foaming liquid is above the suction hole, the area(s) of the suction hole being such that liquid having a speed less than a predetermined speed is able to flow through the hole, except while air is circulating in the supply conduit at a speed greater than the predetermined speed wherein a flow of said air through said supply conduit contributes to a suction effect to draw foaming liquid into said supply conduit; and
a filtering net screen obstructing the discharge conduit.

2. The device of claim 1 which further includes a projection head and a mesh screen positioned in said projection head.

3. A device for producing foam, the device comprising:
a container for containing foaming liquid;
a pump configured to suction foaming liquid via a pumping inlet and expelling foaming liquid via a pumping outlet;
a discharge conduit connected to the pumping outlet;
a supply conduit having a first end connected to the pumping inlet and a second end open to air for the intake of air to produce foam, part of the supply conduit positioned such that the pump is operable if a level of the foaming liquid in the container is above the part of the supply conduit, the supply conduit and both its first and second ends connected and arranged in the container so the fluid in the container does not flow into the interior of the supply conduit, except for fluid flowing through (a) the second end and (b) at least one suction hole formed in a wall of the supply conduit between the two ends coming out in the foaming liquid and positioned such that the pump is operable if the level of the foaming liquid is above the suction hole, the area(s) of the suction hole being such that liquid having a speed less than a predetermined speed is able to flow through the hole, except while air is circulating in the supply conduit at a speed greater than the predetermined speed wherein a flow of said air through said supply conduit contributes to a suction effect to draw foaming liquid into said supply conduit.

4. The device of claim 3 which further includes a filtering net screen positioned over the discharge conduit.

5. The device of claim 3 which further includes a projection head and a mesh screen positioned in said projection head.

* * * * *